United States Patent [19]

Patricia et al.

[11] 4,428,316

[45] Jan. 31, 1984

[54] FEED SYSTEM FOR A SEWING MACHINE

[75] Inventors: John Patricia, Elizabeth; Jan Szostak, Lincroft, both of N.J.

[73] Assignee: The Singer Company, Stamford, Conn.

[21] Appl. No.: 398,023

[22] Filed: Jul. 14, 1982

[51] Int. Cl.[3] ..... D05B 3/04; D05B 27/02

[52] U.S. Cl. ..... 112/323

[58] Field of Search ..... 112/323, 314

[56] References Cited

U.S. PATENT DOCUMENTS

| | | | |
|---|---|---|---|
| 212,628 | 2/1879 | Shanks . | |
| 368,925 | 8/1887 | Angell . | |
| 1,768,104 | 6/1930 | Berger | 112/323 |
| 2,647,481 | 8/1953 | Court . | |
| 2,783,725 | 3/1957 | Eguchi . | |
| 2,931,329 | 4/1960 | Johnson . | |
| 3,023,722 | 3/1962 | Johnson . | |
| 3,347,191 | 10/1967 | Ross . | |
| 3,527,183 | 9/1970 | Szostak . | |
| 3,753,411 | 8/1972 | Graham et al. . | |

*Primary Examiner*—Louis Rimrodt
*Assistant Examiner*—Andrew M. Falik
*Attorney, Agent, or Firm*—Edward P. Schmidt; Robert E. Smith; Edward L. Bell

[57] ABSTRACT

A compact sewing machine feed system utilizing sheet metal parts to reduce inertia, and separate feed and lift cams to simplify replacement for the purpose of optimizing feed characteristics.

2 Claims, 3 Drawing Figures

FEED SYSTEM FOR A SEWING MACHINE

DESCRIPTION

BACKGROUND OF THE INVENTION

This invention is in the field of sewing machines; more particularly, it is concerned with an improved feed system for a sewing machine.

In a feed system for a sewing machine it is desirable that the parts thereof be both strong and have a low inertia so as to limit the power requirements to operate the same and the effort required to regulate the same. This would be particularly true in those sewing machines having what is known as a cam controlled feed system in which patterns may be formed having a variable feed component, either to reduce the wear on a cam which contains the feed information or to reduce the loading on a linear motor which implements the feed information derived from an electronic static memory.

Further, an ideal feed system is adaptable to use in a tubular bed in which the feed system is compact enough to fit within a housing which can extend to the interior of a sleeve, for example. A feature in a household sewing machine in which a flat bed machine is convertible to a tubular bed configuration has shown increasing popularity with the home sewer because of the adaptability of such a machine to many stitching tasks in the home, particularly in the manufacture of clothes.

What is required is a sewing machine which exhibits the required strength while maintaining a low inertia and a compactness which enables its use in a tubular bed. Further, such an arrangement should be provided in an economical and versatile form of construction.

SUMMARY OF THE INVENTION

The above requirements are obtained in a feed system utilizing sheet metal parts in so far as possible in order to obtain lightweight and strong elements which exhibit the desirable low inertia properties. Feed advance is obtained from a constant breadth cam attached to the horizontal arm shaft of the sewing machine and is transferred to a rock shaft in the bed of a sewing machine by a sheet metal feed fork having a longitudinally channeled construction in order to enhance its strength normal to the channel. The rock shaft is formed with two spaced upright arms which are connected by shouldered screws to a horizontally disposed U-shaped sheet metal feed dog carrier. A feed dog is attached to a shelf extending horizontally from the base of the U-shaped sheet metal feed dog carrier. A sheet metal lift lever is grooved on one end to receive a pin extending towards the rock shaft from the base of the U-shaped feed dog carrier beneath the feed dog. The lift lever is approximately centrally pivoted to the sewing machine frame on an eccentric shouldered stud, and from the end opposite the groove there extends, normal thereto, a stud which carries a roller which contacts a lift cam carried on an upright arm shaft above a sprocket for the sewing machine looptaker drive. The extension of the feed dog above the throat plate of the sewing machine is controlled by adjusting the position of the eccentric shouldered stud on which the lift lever is pivoted. All sheet metal parts are arranged to provide the greatest moment of inertia, and thereby the greatest strength, in the direction of the force they transmit. Where necessary, as for example, in the case of the sheet metal feed fork, the strength of the sheet metal part may be enhanced by forming to increase such rigidity. What is provided is a compact feed system utilizing low inertia parts, including parts fabricated of sheet metal, and having separate advance cam and lift cams in order to simplify redesign and replacement thereof to optomize feeding characteristics.

Other objects and advantages will be apparent by the following description of an embodiment of the invention and the novel features will be particularly pointed out hereinafter in the claims.

BRIEF DESCRIPTION OF THE DRAWINGS

This invention is illustrated in the accompanying drawings in which.

DESCRIPTION OF THE INVENTION

Figure 1:
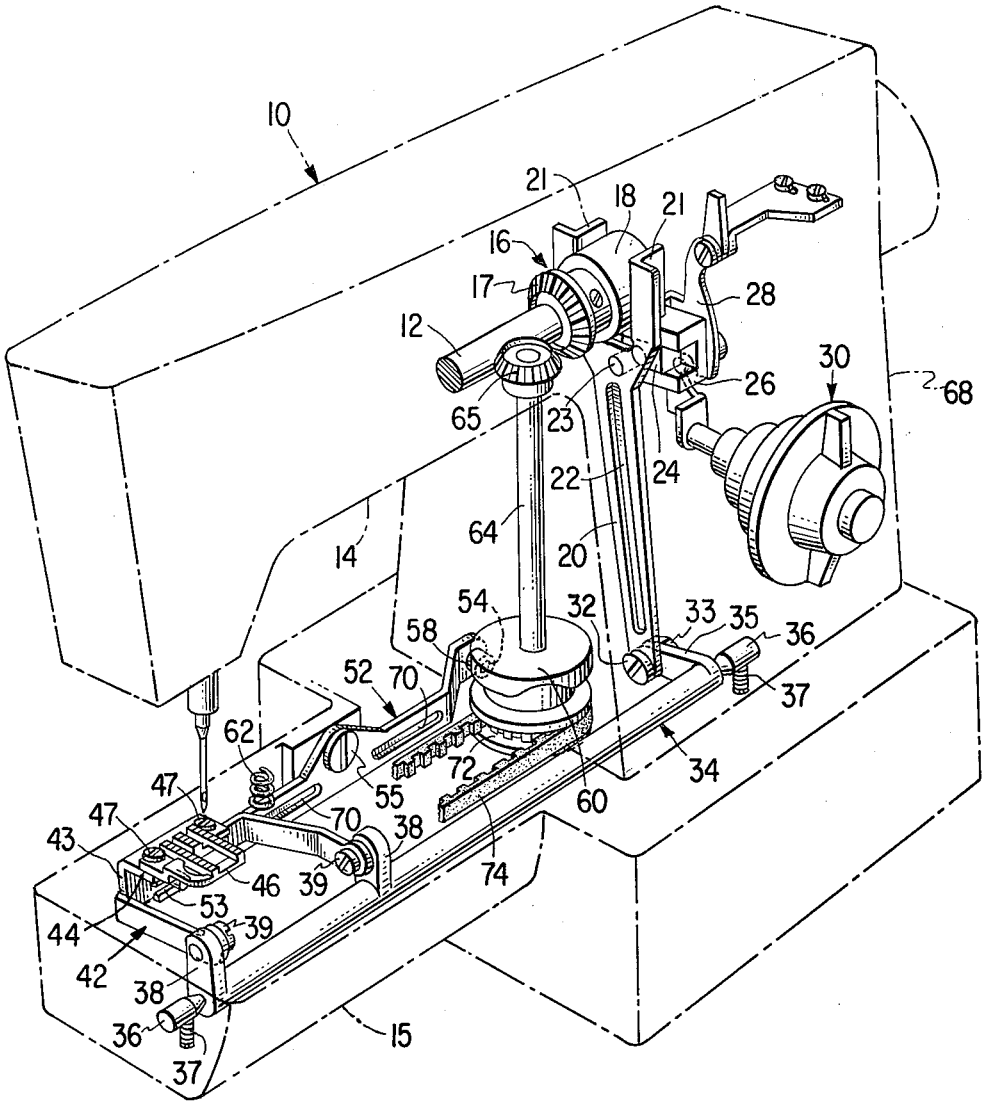
FIG. 1 is a perspective view of a sewing machine in phantom to show clearly the feed system thereof.

Referring particularly to FIG. 1, there is shown in phantom, a sewing machine 10 in which the feed system has been incorporated. A portion of a horizontal arm shaft 12 is shown in the bracket arm 14 of the sewing machine 10, and may be driven in any of many ways well known in the sewing machine art. Supported on the arm shaft 12 is a combined bevel gear and advance cam 16. The advance cam portion 18 of the combined bevel gear and advance cam 16 may be of a variety known as a constant breadth cam, that is of a constant thickness which smoothly shifts its position from predominantly on one side of the axis of the horizontal arm shaft 12 to the other side thereof. The advance cam portion 18 is spanned by the tines 21 of a sheet metal feed fork 20. The sheet metal feed fork 20 is fashioned in one piece from sheet metal, and may be upset to create a channel as at 22 to increase the strength of the fork transverse thereto. The tines 21 of the fork 20 are fashioned to provide an enlarged bearing surface for the advance cam portion 18 by bending out portions of the sheet metal. A pin 23 extends from the feed fork 20 and into a slide block 24 which is captured in the slide of a feed regulator 26 pivotally carried in the sewing machine 10. Also shown, is a feed regulator lever 28 having a pivotal connection to the feed regulator 26 and actuatable by a feed regulator control assembly 30 to change the cant of the feed regulator 26 so as to vary the feed advance as is well known in the sewing machine art.

Figure 3:
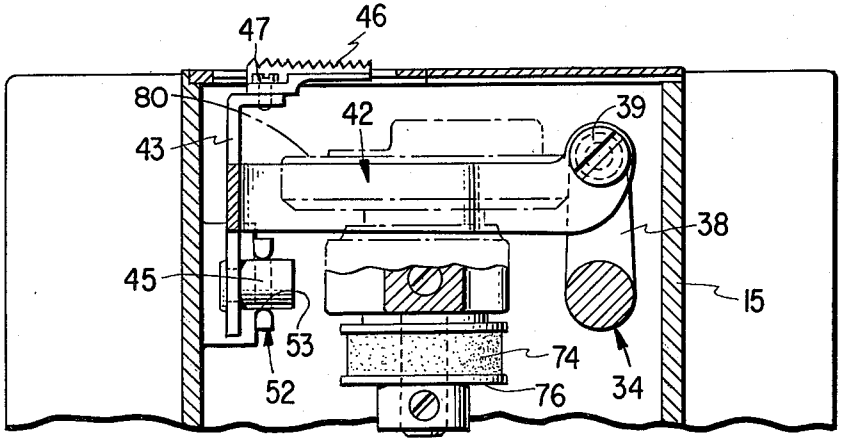

The lower end of the sheet metal fork 20 is adjustably connected by an eccentric screw 32 and nut 33 to an arm 35 of a rock shaft 34 supported on bullet centers 36 which are retained in the proper position in the frame of the sewing machine 10 by set screws 37. The rock shaft 34 oscillates in response to the up and down motion imparted thereto by the feed fork 20 by virtue of its connection to the slide block 24 set in the feed regulator 26. The rock shaft 34 is fashioned at its opposite extreme with a pair of upright rock arms 38 which are connected by screws 39 to the opposite extremes of a U-shaped sewing machine feed dog carrier 42. The base of the U-shaped feed dog carrier 42 is formed with an upward extension 43 (see FIG. 3) which terminates in a horizontally extending shelf 44. A feed dog 46 is attached to the horizontally extending shelf 44 by screws 47. A stud 45 extends inwardly from a downward extension 48 from the base of the U-shaped feed dog carrier 42 beneath the upward extension 43 thereof, and may be fastened thereto by any of a variety of means including riveting.

Figure 2:
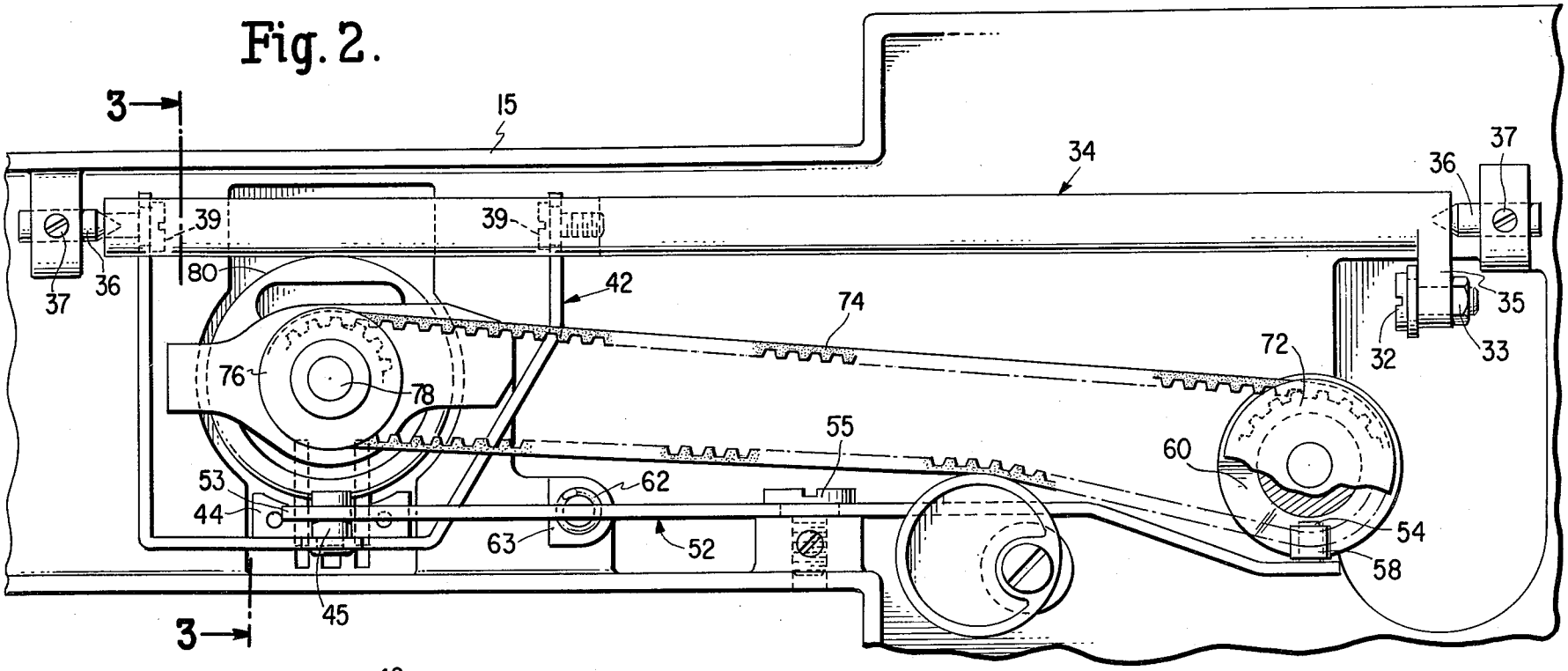
FIG. 2 is a bottom plan of the sewing machine shown in FIG. 1 partially broken away to show details of construction of the feed system; and, FIG. 3 is a side elevation of the sewing machine shown in FIG. 2 and taken substantially along the line 3—3 thereof.

Visible in FIGS. 1 and 2 is a sheet metal lift lever 52 which is substantially centrally pivoted on shouldered eccentric stud 55 carried by the bed 15 of the sewing machine 10. One end of the sheet metal lift lever 52 is slotted as at 53 (see FIG. 3) to receive the stud 45 attached to the downward extension 48 from the base of the U-shaped feed dog carrier 42. The walls of slot 53 are rounded (see FIG. 3) to insure smooth operation and free motion without binding. The opposite end of the lift lever 52 is fashioned with a pin 54 affixed thereto and extending transversely to the lift lever. The pin 54 supports a roller 58 which is in engagement with a lift cam 60 affixed to a vertical arm shaft 64 supported in the standard 68 of the sewing machine 10 joining the bracket arm 14 to the bed 15. The upper end of the vertical arm shaft 64 carries a bevel gear 65 in driving engagement with the bevel gear 17 of the bevel gear and advance cam 16. A coil spring 62 sits in an aperture in boss 63 in the bed 15 and extends between the bed and the sheet metal lift lever 52 so as to urge the roller 58 on the end of the lift lever 52 in constant engagement with the lift cam 60. The lift lever 52 may be channelled as at 70 to further enhance its strength and is utilized edgewise to provide the greatest rigidity and strength when lifting the feed dog against the resistance of any of a variety of presser devices well known in the sewing machine art. Supported on the vertical arm shaft 64 beneath the lift cam 60 is a pulley 72, partially broken away in FIG. 2 which pulley may be of the toothed variety to accommodate a timing belt 74 providing a connection to a second pulley 76 carried on the end of a shaft 78 affixed to a loop taker 80. The use of an independent feed lift cam 60 allows the feed path to be optomized for best performance by replacing the lift cam through the simple expedient of removing the pulley 72 and replacing the lift cam 60 mounted on the vertical arm shaft 64. Fine height adjustment of the feed dog 46 above a throat plate normally used in sewing machines but not disclosed herein for simplicity, is accommodated by providing an eccentric on the shouldered eccentric stud 55, so that rotation of the same will cause the feed dog to project more or less above the throat plate.

Thus, the feed fork 20 converts motion from the cam portion 18 of the bevel gear and advance cam 16 into oscillations of the rock shaft 34. The feed fork 20 is implemented by a sheet metal member which is light and strong. The oscillations of the rock shaft 34 are transferred to the feed dog 46 by way of a sheet metal U-shaped feed dog carrier 42 fashioned in such a way to exhibit lightweight, low inertia, high strength capabilies. The U-shaped feed dog carrier 42 is elevated to a position with the feed dog 46 in contact with a work material for transport of the same by a sheet metal lift lever 52 pivotal in the sewing machine bed in a direction normal to its thickness in order to attain the highest strength and rigidity. A first end of the lift lever 52 is slotted 53 in its connection with the U-shaped feed dog carrier 42, the other end of the lift lever having a pin 54 extending therefrom to support a roller 58 in engagement with the independent and replaceable lift cam 70 attached to the vertical arm shaft 64. The feed system so constructed exhibits extremely low inertia, a high degree of compactness, an extremely economical and versatile form of construction.

It will be understood that various changes in the details, materials, arrangement of parts and operation conditions which have been herein described and illustrated in order to explain the nature of the invention, may be made by those skilled in the art within the principles and scope of the invention.

We claim:

1. A feed system for a sewing machine having a frame, a horizontal arm shaft journalled in said frame, a vertical arm shaft extending downwardly from adjacent said horizontal arm shaft, means rotatably connecting said horizontal arm shaft to said vertical arm shaft, said feed system comprising a cam fixed to said horizontal arm shaft, a sheet metal feed fork having parallel bent over portions at one end thereof embracing said cam and in driving engagement therewith, a feed rock shaft supported in said frame and having an arm connected to the other end of said feed fork, feed regulating means carried by said frame and connected to said feed fork for converting motion induced by said feed cam to oscillations of said rock shaft, said rock shaft being formed with a pair of upright rock arms on the other end thereof, a horizontally disposed U-shaped sheet metal feed dog carrier having each end thereof connected to one of said upright rock arms, said feed dog carrier having a horizontal shelf extending from the base of the U between the ends thereof, said shelf supporting thereon a feed dog, means for attaching said feed dog to said shelf, a stud affixed to said base of said feed dog carrier beneath said shelf, a sheet metal lift lever pivotally supported on a horizontal axis in said frame substantially parallel to said rock shaft, said lift lever having a slotted end for engagement with said stud extending from said feed dog carrier, said lift lever having the other end thereof supporting a cam follower adjacent said vertical cam shaft, and a lift cam removably affixed to said vertical cam shaft and in engagement with said cam follower on said lift lever.

2. A feed system as claimed in claim 1, wherein said sheet metal feed fork, feed dog carrier, and lift lever selectively are formed with channels extending longitudinally thereon to increase the rigidity thereof whereby a lighter guage of sheet metal may be utilized to further reduce the inertia thereof.

* * * * *